United States Patent [19]

Slattery

[11] Patent Number: 4,821,688

[45] Date of Patent: Apr. 18, 1989

[54] AUTOMATIC OIL-FUEL MIXER WITH AUXILIARY CHAMBER

[75] Inventor: Gordon C. Slattery, Omro, Wis.

[73] Assignee: Brunswick Corporation, Skokie, Ill.

[21] Appl. No.: 218,310

[22] Filed: Jul. 12, 1988

[51] Int. Cl.[4] ..... F04B 43/06

[52] U.S. Cl. ..... 123/73 AD; 184/6.5; 417/395

[58] Field of Search ..... 123/196 R, 516, 73 AD, 123/198 DA, 198 D; 184/6.4, 6.5; 417/404, 418, 380, 46, 395

[56] References Cited

U.S. PATENT DOCUMENTS

| | | | |
|---|---|---|---|
| 3,924,975 | 12/1975 | Hundertmark | 417/395 |
| 4,473,340 | 9/1984 | Walsworth | 123/73 AD |
| 4,551,076 | 11/1985 | Dubois | 123/73 AD |
| 4,583,500 | 4/1986 | Hundertmark | 123/73 AD |

FOREIGN PATENT DOCUMENTS

| | | | |
|---|---|---|---|
| 0055467 | 7/1982 | European Pat. Off. | 417/395 |

*Primary Examiner*—David A. Okonsky

*Attorney, Agent, or Firm*—Andrus, Sceales, Starke & Sawall

[57] ABSTRACT

A marine propulsion system (200) having an outboard two cycle internal combustion engine (212) has a modified oil-fuel mixer (2, 602) preventing excess oil in the mixture as fuel runs out. The modified mixer includes an auxiliary chamber (602) having a fuel inlet (604) receiving fuel from the working chamber (22) of the mixer below a given level, a vapor inlet (606) receiving fuel vapor or air from the working chamber above the given level, and a vapor outlet (608) exhausting the vapor. When the fuel tank (5) runs dry, air is drawn through a transfer passage (38) in the mixer to one side of the moveable diaphragm (24), and fuel pump (11) suction is applied to both sides of the diaphragm to halt movement thereof and stop further pumping of oil from the oil tank (7) to the engine. The invention also enchances accuracy of the oil-fuel mixture ration during normal operation.

6 Claims, 1 Drawing Sheet

AUTOMATIC OIL-FUEL MIXER WITH AUXILIARY CHAMBER

BACKGROUND AND SUMMARY

The present invention relates to marine propulsion systems having an outboard two cycle internal combustion engine and a remote fuel tank, and more particularly to the fuel delivery system therefore.

The invention arose during development efforts directed toward solving a problem occuring as fuel runs out in systems using an autoblend oil-fuel mixer, sometimes referred to as an autoblend unit, for example as shown in U.S. Pat. No. 4,583,500, incorporated herein by reference. The mixer draws fuel from a fuel tank and oil from an oil tank in a given ratio, typically about 50 parts fuel to 1 part oil, and automatically mixes the fuel and oil, eliminating the need to premix same. The mixer has a fuel inlet, an oil inlet, an oil-fuel outlet, and is operated by a pressure differential between the fuel inlet and the oil-fuel outlet. The mixer may be operated by various sources of pressure differential, for example the mixer may be connected downstream of the fuel pump and use fuel pressure to operate the mixer. In other applications where a pressurized fuel tank is utilized, such pressure may be used to operate the mixer. In other implementations, crankcase pressure and/or vacuum may be used to operate the mixer, or a separate dedicated small pump may be used. In other implementation, the mixer is connected upstream of the fuel pump such that fuel pump suction on the oil-fuel outlet operates the mixer. In all the implementations, a problem of an overly rich oil-fuel mixture being supplied to the engine arises as fuel runs out.

In the last noted implementation, when the fuel tank runs out of fuel, then air from the tank is sucked through the mixer by the fuel pump. This air flow through the mixer continues to operate the mixer and causes continued delivery of oil from the oil tank to the engine, which in turn causes excess oil in the oil-fuel mixture as the fuel runs out, i.e. there is an overly rich oil-fuel mixture supplied to the engine from the remaining oil-fuel mixture in a carburetor bowl or the like as the latter runs dry.

The present invention addresses and solves the noted problem. Another solution is shown in copending application Ser. No. 07/217,655, filed July 12, 1988, entitled "Fuel System With Vapor Bypass Of Oil-Fuel Mixer Halting Oil Pumping".

It has also been found that the present invention enhances accuracy of the oil-fuel mixture ratio. In order to provide an accurate mix, the fuel must be in liquid form. If the fuel is in the form of vapor or if there are vapor or air bubbles in the fuel, then such air or vapor will displace the fuel in the mixer, and the oil-fuel mixture ratio will not be accurate. In the worst case, when only air is being drawn through the mixer as above noted when fuel runs out, then the mixer will provide all oil and no fuel. The present invention reduces the amount of vapor in the fuel, to increase the amount of fuel in liquid form that is mixed with the oil in the mixer, to enhance accuracy of the mixture ratio.

DETAILED DESCRIPTION

Figure 1:
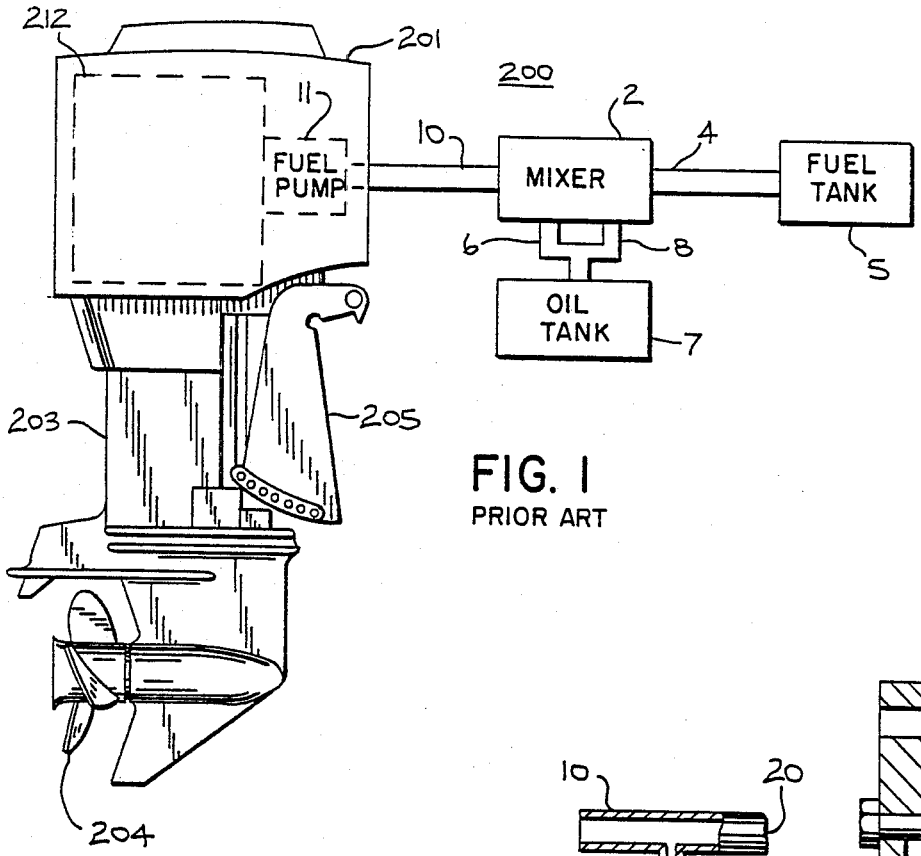
FIG. 1 PRIOR ART
FIG. 1 schematically shows a marine propulsion system and fuel delivery system known in the prior art.
Figure 2:
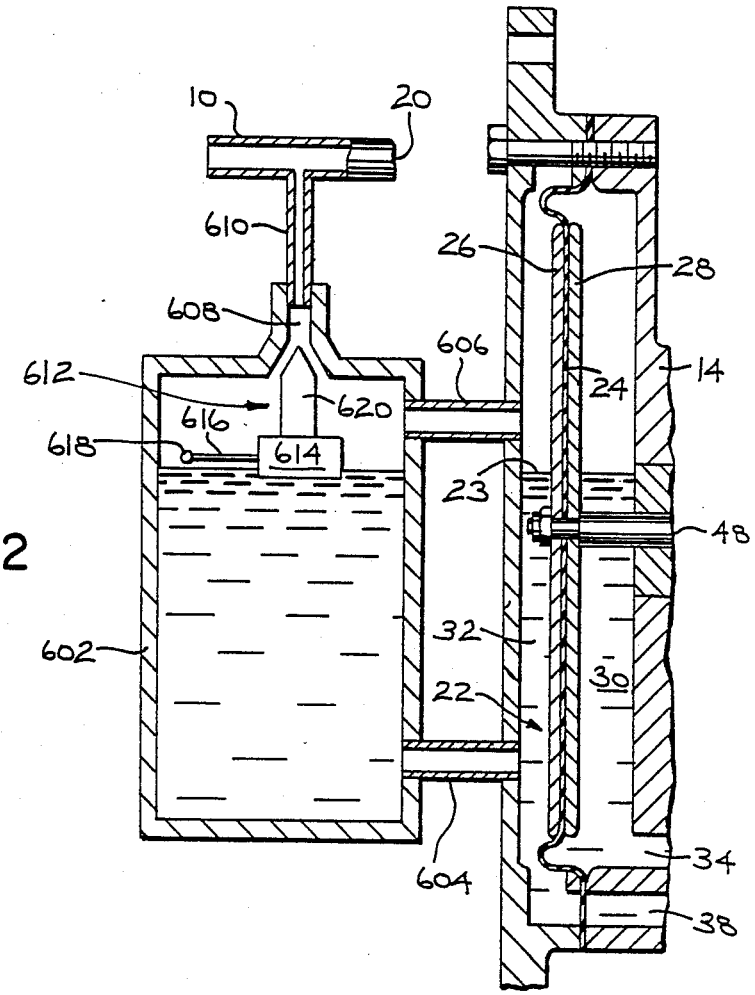
FIG. 2 shows a modified oil-fuel mixer in accordance with the invention.

FIGS. 1 and 2 use like reference numerals from incorporated U.S. Pat. No. 4,583,500 where appropriate to facilitate clarity. FIG. 1 shows a marine propulsion system 200 including an outboard propulsion unit having a powerhead 201 with a two cycle crankcase compression internal combustion engine 212 and having a lower depending gearcase 203 and propeller 204, and mounted to the transom of a boat (not shown) by transom bracket 205. A remote fuel tank 5 is within the boat. An oil-fuel mixer 2, as shown in incorporated U.S. Pat. No. 4,583,500, draws fuel from fuel tank 5 and oil from oil tank 7, and delivers an oil-fuel mixture to the engine. Mixer 2 has a fuel inlet 4 receiving fuel from fuel tank 5, an oil inlet 6, 8 receiving oil from oil tank 7, and an oil-fuel outlet 10 at port 20, FIGS. 2–4 of U.S. Pat. No. 4,583,500, delivering the oil-fuel mixture to the intake suction vacuum side of fuel pump 11, which is a crankcase pressure pulse driven pump, Mercury Marine Brunswick Corp., *Outboard Service Training Notebook,* Bulletin 90-90592 3-1286, pages 10–11, and for example U.S. Pat. No. 3,924,975, incorporated herein by reference. Mixer 2 is operated by a pressure differential between fuel inlet 4 and oil-fuel outlet 10. Fuel pump 11 suctions the oil-fuel mixture from oil-fuel outlet 10 of the mixer to provide such pressure differential.

As above noted, a problem with excell oil in the mixture occurs when fuel tank 5 runs out of fuel, because air from fuel tank 5 is then sucked through mixer 2 to operate same, such that the mixer continues to pump oil from oil tank 7 to oil-fuel outlet 10, whereby the mixture contains all oil and no fuel. This in turn causes an overly rich oil-fuel mixture to be supplied to the engine from the remaining mixture in a carburetor bowl, fuel injection system, or the like as the latter runs dry.

The present invention is shown in FIG. 2 which shows a portion of the structure of FIG. 2 of incorporated U.S. Pat. No. 4,583,500 but turned upside down to facilitate understanding. FIG. 2 shows valve housing 14, working chamber 22 in the valve housing, and moveable diaphragm 24 in the working chamber and moved by fuel pressure differential thereacross. Movement of diaphragm 24 moves plunger rod 48 axially which in turn drives oil pump 44, as shown in FIG. 2 of U.S. Pat. No. 4,583,500, which pumps oil from oil tank 7 into the mixer. Fuel fills to a given level 23 in the working chamber. An auxiliary chamber 602 has a fuel inlet 604 receiving fuel from working chamber 22 below level 23. Chamber 602 has a vapor inlet 606 receiving fuel vapor or air from working chamber 22 above level 23. Chamber 602 has a vapor outlet 608 exhausting the fuel vapor or air. Outlet 608 delivers the vapor through a bypass connection 610 to the engine through fuel pump 11. Outlet 608 is connected by bypass connection 610 preferrably to the oil-fuel outlet 10 of the mixer such that the vapor is suctioned by fuel pump 11.

Moveable diaphragm 24, with support plates 26 and 28, divides chamber 22 into first and second sections 30 and 32 isolated and separated by diaphragm 24 and of inversely variable volume according to movement of diaphragm 24 axially right-left. A first transfer passage 34 communicates between transition chamber 12, FIG. 2 of U.S. Pat. No. 4,583,500, at transfer port 36, and the first section 30 of working chamber 22 on the first side 28 of diaphragm 24. A second transfer passage 38 communicates between transition chamber 12 at transfer port 40 and the second section 32 of working chamber 22 on the second side 26 of diaphragm 24.

Cyclic transition means 42, FIG. 2 of U.S. Pat. No. 4,583,500, is provided in chamber 12, and has a first half cycle providing communication between fuel inlet 4 and first transfer passage 34, and between second transfer passage 38 and oil-fuel outlet 10 at port 20. Fuel entering fuel inlet 4 flows through inlet port 16, chamber 12, transfer port 36, and transfer passage 34 to the first section 30 of working chamber 22 to drive diaphragm 24 leftwardly expanding section 30 and contracting section 32, expelling fuel from section 32 through transfer passage 38, transfer port 40 and chamber 12 to oil-fuel outlet port 20 and outlet 10. Oil pump 44 is driven by movement of the diaphragm to operatively pump oil from oil inlet 6, 8 to the oil-fuel outlet port 20 at outlet 10, preferrably via oil transfer passage 46 connected to fuel inlet 4. Transition means 42 has a second half cycle, FIG. 3 of U.S. Pat. No. 4,583,500, providing communication between fuel inlet 4 and second transfer passage 38, and between first transfer passage 34 and oil-fuel outlet port 20. In the second half cycle, fuel entering inlet 4 flows through inlet port 18, chamber 12, transfer port 40, and transfer passage 38 to the second section 32 of the working chamber and drives diaphragm 24 rightwardly expanding section 32 and contracting section 30, expelling fuel from section 30 through transfer passage 34, transfer port 36, and chamber 12 to oil-fuel outlet port 20 at outlet 10.

A float actuated shut-off valve 612 in auxiliary chamber 602 closes outlet 608 when the fuel level in chamber 602 rises to a given level. The valve has a float 614 connected by lever 616 to pivot point 618 fixed to the chamber, such that as the fuel level in chamber 602 rises, valve 620 moves upwardly to close outlet 608. When sufficient air or vapor is present, the fuel level lowers and valve 612 opens and allows the vapor or air to flow directly to outlet 10 of the mixer. When no vapor or air, or only a minimum amount thereof is present, valve 612 closes. Vapor from outlet 608 is delivered through bypass connection 610 to the suction intake side of fuel pump 11 at oil-fuel outlet 10 of the mixer.

When fuel tank 5 runs out of fuel, and during the above noted first half cycle, then air from fuel tank 5 is drawn through transfer passage 34 into working chamber section 30 as diaphragm 24 moves leftwardly due to the suction of the fuel pump applied through transfer passage 38 to working chamber section 32. In the noted second half cycle, fuel pump suction is applied through transfer passage 34 to working chamber section 30. If the fluid level in chamber 602 is high enough to close valve 612, then diaphragm 24 will move rightwardly, drawing air from fuel tank 5 through transfer passage 38 to working chamber section 32. If the fuel level in chamber 602 is sufficiently low to open valve 612, then fuel pump suction is applied through bypass connection 610 and connection 606 to working chamber section 32, such that fuel pump suction is applied to both the left and right sides of the diaphragm, which eliminates the pressure differential thereacross, and hence stops movement of the diaphragm, with the diaphragm remaining in its leftward position. During the following first half cycle, fuel pump suction is applied through transfer passage 38 to working chamber section 32 and is also applied through bypass connection 610 and connection 606 to working chamber section 32, but diaphragm 24 is already in its leftward position and hence cannot travel any further leftwardly, whereby the diaphragm remains stationary. During the following second half cycle, fuel pump suction is applied to both the left and right sides of the diaphragm, and hence the diaphragm does not move, but instead remains stationary in its leftward position. Stopping the movement of the diaphragm stops movement of plunger rod 48 and oil pump 44, FIG. 2 of U.S. Pat. No. 4,583,500, which stops operation of the mixer and stops further delivery of oil from oil tank 7 to mixer outlet 10 and the engine which would otherwise cause an overly rich oil-fuel mixture supplied to the engine from the remaining oil-fuel mixture in a carburetor bowl or the like.

The invention also enhances accuracy of the oil-fuel mixture ratio by removing vapor from the fuel during the notes second half cycles. If the fuel drawn from tank 5 through transfer passage 38 into working chamber section 32 has vapor in it of sufficient amount to lower the liquid fuel level in auxiliary chamber 602 to open valve 612, then such vapor is exhausted through outlet 608 and bypass connection 610 due to the fuel pump suction applied at mixer outlet 10.

It is recognized that various equivalents, alternatives and modifications are possible within the scope of the appended claims.

I claim:

1. A marine propulsion system comprising an outboard two cycle internal combustion engine, a fuel tank, an oil tank, an oil-fuel mixer having a fuel inlet receiving fuel from said fuel tank, an oil inlet receiving oil from said oil tank, and an oil-fuel outlet delivering an oil-fuel mixture to said engine, said mixer comprising:

a valve housing;

a working chamber in said valve housing;

a moveable diaphragm in said working chamber and moved by fuel pressure differential thereacross;

an oil pump in said valve housing driven by movement of said diaphragm;

wherein fuel fills to a given level in said working chamber;

an auxiliary chamber having a fuel inlet receiving fuel from said working chamber below said given level, a vapor inlet receiving fuel vapor from said working chamber above said given level, and a vapor outlet exhausting said fuel vapor.

2. The invention according to claim 1 wherein said vapor outlet of said auxiliary chamber is connected to said oil-fuel outlet of said mixer.

3. The invention according to claim 1 comprising in combination a float actuated shut-off valve in said auxiliary chamber responsive to a predetermined fuel level in said auxiliary chamber to close said vapor outlet of said auxiliary chamber.

4. A marine propulsion system comprising an outboard two cycle internal combustion engine, a fuel tank, an oil tank, an oil-fuel mixer having a fuel inlet receiving fuel from said fuel tank, an oil inlet receiving oil from said oil tank, an oil-fuel outlet delivering an oil-fuel mixture to said engine, said mixer comprising:

a housing;

a pressure differential working chamber in said housing;

a moveable diaphragm in said working chamber dividing said working chamber into first and second sections;

first and second transfer passages communicating respectively with said first and second sections of said working chamber on respective first and second sides of said diaphragm;

cyclic transition means having a first half cycle providing communication between siad fuel inlet and said first transfer passage and between said second transfer passage and said oil-fuel outlet such that fuel entering said fuel inlet flows through said first transfer passage to said first section of said working chamber on said first side of said diaphragm to move said diaphragm to expel fuel from said second section of said working chamber through said second transfer passage to said oil-fuel outlet, said transition means having a second half cycle providing communication between said fuel inlet and said second transfer passage and between said first transfer passage and said oil-fuel outlet such that fuel entering said fuel inlet flows through said second transfer passage to said second section of said working chamber on said second side of said diaphragm to move said diaphragm to expel fuel from said first section of said working chamber through said first transfer passage to said oil-fuel outlet;

oil pump means driven by movement of said diaphragm to operatively pump oil from said oil inlet to said oil-fuel outlet;

wherein fuel fills to a given level in a given one of said sections of said working chamber;

an auxiliary chamber having a fuel inlet receiving fuel from said one section of said working chamber below said given level, a vapor inlet receiving fuel vapor from said one section of said working chamber above said given level, and a vapor outlet exhausting said fuel vapor.

5. A marine propulsion system comprising an outboard two cycle internal combustion engine running on an oil-fuel mixture, a fuel system preventing excess oil in said mixture as said fuel runs out, comprising a fuel tank, an oil tank, an oil-fuel mixer having a fuel inlet receiving fuel from said fuel tank, an oil inlet receiving oil from said oil tank, and an oil-fuel outlet delivering an oil-fuel mixture to said engine, said mixer being operated by a pressure differential between said fuel inlet and said oil-fuel outlet, a fuel pump suctioning said oil-fuel mixture from said oil-fuel outlet of said mixer to provide said pressure differential, and pumping said oil-fuel mixture to said engine, said mixer comprising;

a housing;

a working chamber in said housing;

a moveable diaphragm in said working chamber and moved by fuel pressure differential thereacross;

an oil pump in said housing driven by movement of said diaphragm;

wherein fuel fills to a given level in said working chamber;

an auxiliary chamber having a fuel inlet receiving fuel from said working chamber below said given level, a vapor inlet receiving fuel vapor from said working chamber above said given level, and a vapor outlet delivering vapor through a bypass connection to said fuel pump, such that if said fuel tank runs out of fuel, then air is sucked from said fuel tank through said fuel inlet of said mixer into said working chamber and through said vapor inlet of said auxiliary chamber and through said vapor outlet of said auxiliary chamber and said bypass connection to said fuel pump rather than from said working chamber through said oil-fuel outlet of said mixer to said fuel pump, to stop further movement of said diaphragm and stop further delivery of oil by said oil pump from said oil tank to said engine which would otherwise cause an overly rich oil-fuel mixture supplied to said engine from the remaining oil-fuel mixture in a carburetor bowl or the like.

6. The invention according to claim 5 comprising in combination a float actuated shut-off valve in said auxiliary chamber responsive to a predetermined fuel level in said auxiliary chamber to close said vapor outlet of said auxiliary chamber.

* * * * *